US005113767A

United States Patent [19]

Theurer

[11] Patent Number: 5,113,767

[45] Date of Patent: May 19, 1992

[54] CONTINUOUS ACTION BALLAST COMPACTING MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 637,218

[22] Filed: Jan. 3, 1991

[30] Foreign Application Priority Data

Feb. 6, 1990 [AT] Austria ..... A249/90

[51] Int. Cl.[5] ..... E01B 33/02

[52] U.S. Cl. ..... 104/7.2; 104/8; 33/287

[58] Field of Search ..... 104/2, 7.1, 7.2, 10, 104/12, 8; 33/523.1, 523.2, 287; 73/146

[56] References Cited

U.S. PATENT DOCUMENTS

| | | | |
|---|---|---|---|
| 3,391,648 | 7/1968 | Stewart | 104/7.2 |
| 3,608,497 | 9/1971 | Plasser | 104/12 |
| 4,046,079 | 9/1977 | Theurer | 104/7.2 |
| 4,064,807 | 12/1977 | Theurer | 104/7.2 |
| 4,497,255 | 2/1985 | Theurer | 104/7.2 |
| 4,643,101 | 2/1987 | Theurer | 104/7.2 |
| 4,658,730 | 4/1987 | Beckmann et al. | 104/7.2 |

*Primary Examiner*—Robert J. Oberleitner
*Assistant Examiner*—Mark T. Le
*Attorney, Agent, or Firm*—Collard, Roe & Galgano

[57] ABSTRACT

A continuously advancing track working machine for compacting ballast comprises a self-propelled machine frame supported by undercarriages on the track for mobility in an operating direction and a track stabilization assembly vertically adjustably mounted on the machine frame between the undercarriages. The track stabilization assembly comprises drives for vertically adjusting the assembly, oscillatory rolling tools arranged for engaging the rails, vibrators for oscillating the rolling tools, and spreading drives for pressing the rolling tools against the gage sides of the rails. Lining drives link the track stabilization assembly to the machine frame for displacing the track engaged by the rolling tools pressed against the track rails in a direction extending transversely to the track, under the control of a lining reference system including a lining reference base, and a measuring device is arranged on the machine frame adjacent the track stabilization assembly for measuring the transverse track displacement relative to the lining reference base into a desired position.

12 Claims, 2 Drawing Sheets

CONTINUOUS ACTION BALLAST COMPACTING MACHINE

BACKGROUND OF THE INVENTION

1. Field of the Invention

The present invention relates to a continuously advancing track working machine for compacting ballast supporting a track comprised of two rails fastened to a succession of ties, each rail having a gage side and a field side, which comprises a self-propelled machine frame supported by undercarriages on the track for mobility in an operating direction, a track stabilization assembly vertically adjustably mounted on the machine frame between two of these undercarriages, the track stabilization assembly comprising drive means for vertically adjusting the assembly, oscillatory rolling tools arranged for engaging the rails, vibrating means for oscillating the rolling tools, and drive means for pressing the rolling tools against the gage sides of the rails. Lining drives link the track stabilization assembly to the machine frame for displacing the track engaged by the rolling tools pressed against the track rails in a direction extending transversely to the track, under the control of a lining reference system including a lining reference base having a leading and a trailing end point in the operating direction.

2. Description of the Prior Art

A dynamic track stabilizer of this type for compacting a ballast bed has been disclosed in U.S. pat. no. 4,064,807, dated Dec. 27, 1977. The vertically adjustable track stabilization assembly runs on the track rails on flanged wheels whose flanges are pressed without play against the gage sides of the rails and laterally pivotal flat rollers are pivoted into engagement with the field sides of the rails to hold the track rails firmly while the assembly is vibrated to impart oscillations to the track in a substantially horizontal plane and a substantially vertically extending load is applied to the assembly by hydraulic vertical adjustment drives. The flanged wheels and the flat rollers constitute the rolling tools of the track stabilization assembly, and the track will be settled by condensing the supporting ballast under the static load while the machine continuously advances along the track. The track level is controlled by a leveling reference system comprised of two tensioned reference wires and a lining reference system is mentioned without being described or illustrated.

U.S. pat. no. 4,046,079, dated Sept. 6, 1977, shows such a dynamic track stabilizer coupled to a track tamping machine. A conventional reference system extends along the track stabilizer and the tamping machine, and its tensioned reference wire is guided without play along the guide rail of the track to indicate and record the existing track position. Any deviations of the existing track position from a desired track position are corrected by lining drives which transversely displace the track. The reference system is aligned principally with respect to the tamping machine.

U.S. pat. no. 4,643,101, dated Feb. 17, 1987, discloses a continuous action track working machine with an elongated two-part machine frame whose parts are hinged together. The leading machine frame part constitutes a track leveling, lining and tamping machine carrying an operating unit which is longitudinally displaceable relative to the machine frame. The trailing machine frame part carries two track stabilization assemblies and a vertically adjustable track sensing element is guided along the track between the two assemblies. A contact at the upper end of the track sensing element is associated with a tensioned reference wire of a leveling reference system associated with each track rail. A tensioned reference wire of a lining reference system extends centrally between the rails from the leading to the trailing end of the machine frame, and another track sensing element at the operating unit cooperates with the lining reference wire to control the lining operation.

SUMMARY OF THE INVENTION

It is the primary object of this invention to provide a continuous action track working machine of the first-described type for compacting ballast and which enables the track to be accurately lined while the horizontal and transversely oriented oscillations and the vertical pressure imparted to the track cause the track to be settled in the condensed ballast.

The above and other objects are accomplished according to one aspect of the invention with such a track working machine by arranging a measuring device on the machine frame adjacent the track stabilization assembly for measuring the transverse track displacement relative to the lining reference base into a desired position. The measuring device may be affixed directly to the machine frame or the machine may further comprise a transversely extending measuring axle rolling on the track, and an elastic bearing supporting the measuring device on the measuring axle.

This arrangement for the first time enables a conventional dynamic track stabilizer to be used as a track liner which produces an accurate track lining which can be monitored and controlled.

According to another aspect of the present invention, a track is lined with a continuously advancing track working machine by continuously measuring any deviation of the existing track position from a desired track position relative to a lining reference system to obtain signals indicating the difference between the existing and desired track positions, and transversely displacing the track in response to these signals by subjecting the track to oscillations extending in a substantially horizontal plane transversely to the track to exert lining forces against the track until the track has been displaced into the desired position. Such a track lining method has the advantage that the required lining forces imparted to a vibrating track, which is comparable to a body swimming in water, are relatively small compared to those necessary to exert upon a stationary track in conventional track lining. Furthermore, the oscillations tend to prevent or reduce the stresses in the rails due to their transverse movement so that the track rails will not tend to snap back and the lined track will remain in its lined position. Finally, lining and dynamic track stabilization will be effected with one machine and no additional track stabilizer will be required.

Preferably, the continuously advancing track working machine first measures and records the existing position of the track, a conventional track geometry computer computes an optimal desired track position on the basis of the recorded existing track position, and, in a subsequent continuous advance of the track working machine, the lining forces are automatically controlled in response to the computed deviation of the existing track position from the optimal desired track position, on the one hand, and the obtained signals indicating the difference between the existing and desired track positions, on the other hand. In this way, the lining can be continuously measured in a first pass of the machine and the measured transverse track displacement values can then be compared in a second pass with the computed desired values. This enables a track to be lined very economically solely with the dynamic track stabilizer of this invention and without the previous use of a track lining and tamping machine.

If the measuring device is supported by an elastic bearing, it will be substantially protected from the high transverse acceleration forces imparted to the track so that it will function properly over a long period of time without losing its measuring accuracy.

According to a preferred embodiment, a further such measuring device is arranged between the first-named measuring device and the trailing end point of the reference base. The provision of the second measuring device enables the transverse track displacement effected at the first, leading measuring device to be monitored continuously by the second, trailing measuring device.

The reference base may be a tensioned wire, and the machine may further comprise two measuring axles rolling on the track, and elastic bearings supporting the measuring devices on the measuring axles, the measuring devices emitting measuring signals indicating the linear path of the transverse track displacement relative to the tensioned reference wire. This arrangement has the advantage that the transverse track displacement can be accurately and dependably measured as the machine continuously advances along the track without being in any way influenced by the high mechanical stresses produced by the permanent track vibrations. Any such interference with the measuring signals may be fully eliminated by an electronic filter associated with the measuring device for filtering out any oscillations interfering with the transverse displacement measurements.

The track working machine may further comprise a laser beam receiver mounted adjacent the leading reference base end point for advancement with the machine, an independently movable carriage preceding the machine frame in the operating direction, and a laser beam emitter mounted on the carriage. This arrangement enables the reference base of the lining reference system to be guided accurately in a long stretch of track along a desired line determined by the laser beam emitter, and thus to eliminate any short-range lining errors and further to enhance the accuracy of the lining operation.

The reference base may be constituted by the machine frame. The machine frame is rigid and provides a simple reference base since it is heavy enough and spaced far enough from the vibrating track to be practically free of interfering oscillations.

The measuring device may comprise an optoelectronic sensor affixed to the machine frame for optically sensing the transverse track displacement, wherein the sensor is arranged for optically sensing one of the track rails or a displacement reference fixedly arranged for displacement with the track. This arrangement very advantageously enables the path of the transverse track displacement to be measured accurately without contact with the vibrating track, which considerably enhances the operating life and the dependable functioning of the measuring device.

The measuring device may also comprise an inductive or capacitative displacement pickup device for measuring the transverse displacement and emitting a corresponding output signal, and the machine may further comprise a measuring wheel rolling on the track and rotatable about a transverse axle, the measuring device being connected to the machine frame and the transverse measuring wheel axle. Such a measuring device also provides an advantageous, contactless measurement which is relatively simple and can be mounted without any problem on measuring axles contacting the vibrating track.

According to another preferred embodiment, the machine comprises two track stabilization assemblies sequentially arranged in the operating direction and linked to the machine frame by respective lining drives, the measuring device being arranged between the track stabilization assemblies. This combination of two track stabilization assemblies and a total of four lining drives enables the lining forces to be transmitted to the track effectively and without undue stress at single lining points, the transverse track displacement being accurately measurable by centering the measuring device between the two track stabilization assemblies.

BRIEF DESCRIPTION OF DRAWING

The above and other objects, advantages and features of the present invention will become more apparent from the following detailed description of certain now preferred embodiments thereof, taken in conjunction with the accompanying, somewhat diagrammatic drawing wherein.

DETAILED DESCRIPTION OF PREFERRED EMBODIMENTS

Figure 1:
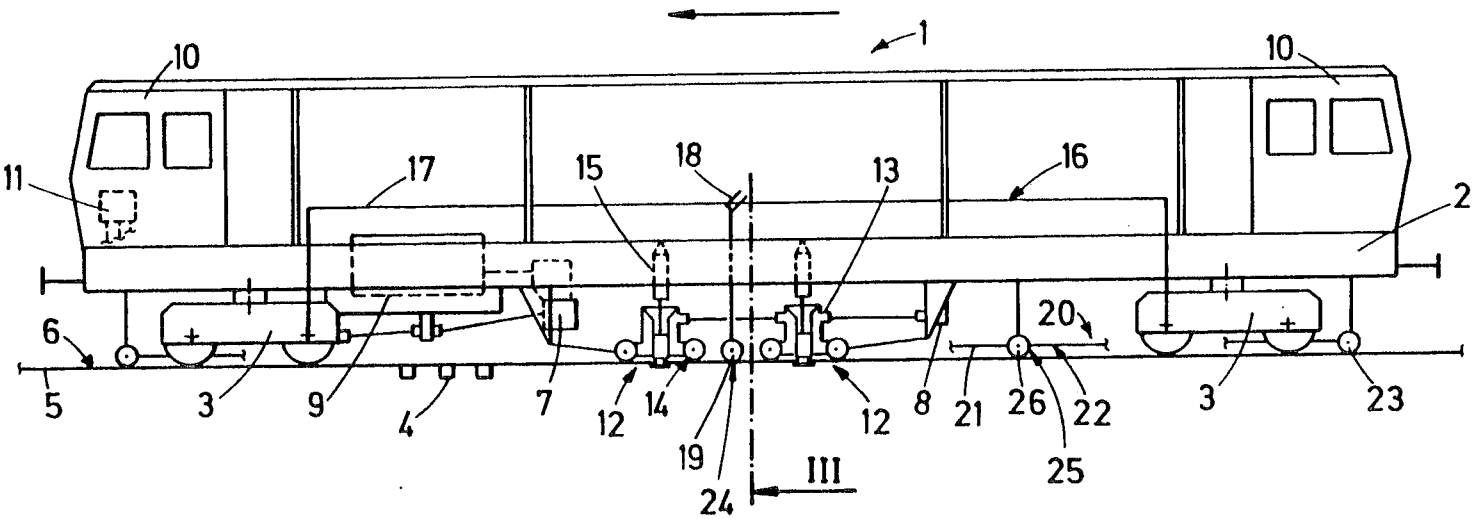
FIG. 1 is a side elevational view of a track working machine according to this invention.

Referring now to the drawing and first to FIG. 1, there is shown continuously advancing track working machine 1 for compacting ballast supporting track 6 comprised of two rails 5 fastened to a succession of ties 4, each rail having a gage side and a field side. The illustrated machine is known as a dynamic track stabilizer and comprises a self-propelled, rigidly structured machine frame 2 supported at respective ends thereof by undercarriages 3, 3 on the track for mobility in an operating direction indicated by a horizontal arrow. Central power plant 9 is mounted on machine frame 2 and supplies power to drive 7 for propelling the machine, vibrating drive 8 for vibrating track stabilization assemblies 12, 12 and any other operating drives of the machine. The illustrated undercarriages are swivel trucks, and pivotal frames mount sound-proof operator's cabs 10, 10 on machine frame 2 at respective ends thereof above the swivel trucks. A central control computer and recording unit 11 is provided for controlling the drives and processing the measuring signals.

In the illustrated embodiment of track working machine 1, two track stabilization assemblies 12, 12 are vertically adjustably mounted on the machine frame between the two undercarriages 3, 3, and each track stabilization assembly comprises hydraulic drive means 15 linking the assembly to machine frame 2 for vertically adjusting the assembly, oscillatory rolling tools 14, 14 arranged for engaging rails 5, 5, vibrating means 13 for oscillating the rolling tools, and drive means for pressing rolling tools 14, 14 against the gage sides of rails 5, 5. Hydraulic lining drive means 15 are operable to exert a static load on track stabilization assemblies 12, 12 and two lining drives 29, 29 (see FIG. 3) link each track stabilization assembly to machine frame 2 for displacing track 6 engaged by rolling tools 14, 14 pressed against track rails 5, 5 in a direction extending transversely to the track. The track working machine further comprises lining reference system 20 including lining reference base 22 having a leading and a trailing end point in the operating direction, and leveling reference system 16 including tensioned reference wires 17 extending above each track rail and cooperating with track level pickups 18 mounted on measuring axle 19 rolling on track 6 and emitting an output signal corresponding to the track level indicated by the measuring axle and controlling the level of the track settled by operation of track stabilization assemblies 12, 12. The lining reference base illustrated in FIGS. 1 and 2 is also a tensioned wire 21 which extends between leading and trailing measuring carriages 23 whose flanged wheels run on track rails 5.

Figure 6:
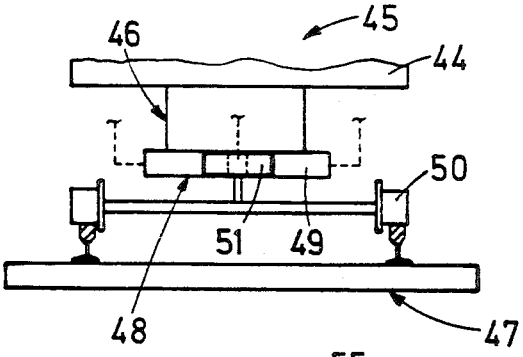
FIGS. 6 and 7 are schematic end views illustrating two different embodiments of a measuring device for measuring the transverse track displacement.
Figure 7:
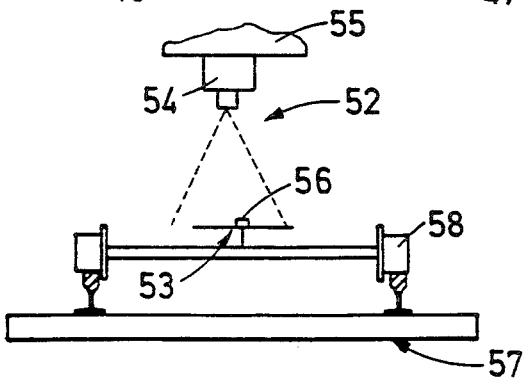

According to this invention, measuring device 24 is arranged on machine frame 2 adjacent and between track stabilization assemblies 12, 12 for measuring the transverse track displacement relative to lining reference base 22 into a desired position. In the embodiment of FIGS. 1 to 4, transverse measuring axle 19 has flanged measuring wheels rolling on the track, and elastic bearing 32 supports the measuring device on the measuring wheel axle. In the embodiments of FIGS. 6 and 7, the measuring device is affixed directly to the machine frame.

Figure 2:
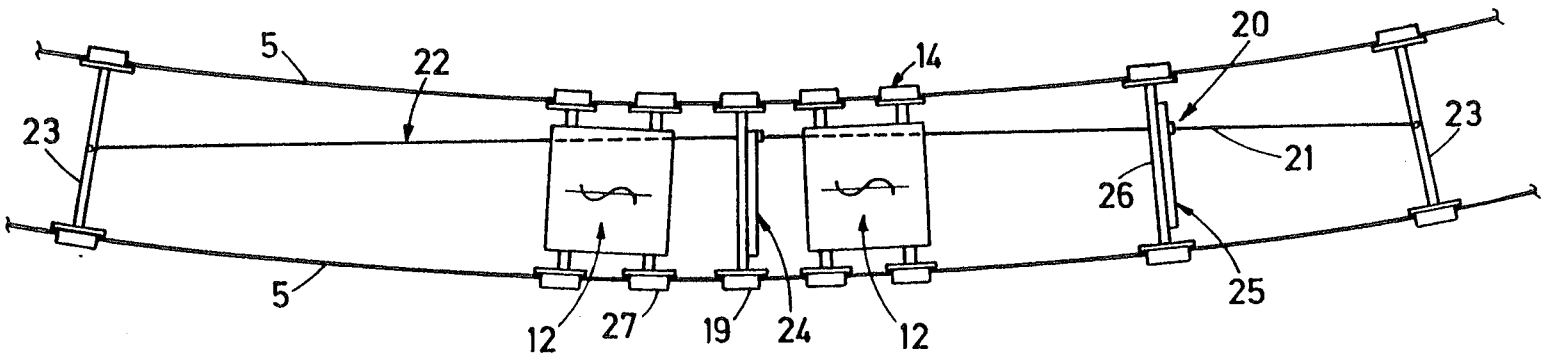
FIG. 2 is an enlarged, schematic top view of the track stabilization assemblies, the measuring devices and the lining reference system of the track working machine of FIG. 1.

In the embodiment illustrated in FIGS. 1 and 2, track working machine 1 comprises a further measuring device 25 arranged between measuring device 24 and the trailing end point of reference base 22. As in measuring axle 19, the two flanged wheels of transverse measuring axle 26 monitor the track level and line, and measuring devices 24, 25 emit measuring signals indicating the linear path of the transverse track displacement relative to tensioned reference wire 21. An electronic filter may be associated with each measuring device for filtering out any oscillations interfering with the transverse displacement measurements.

Figure 3:
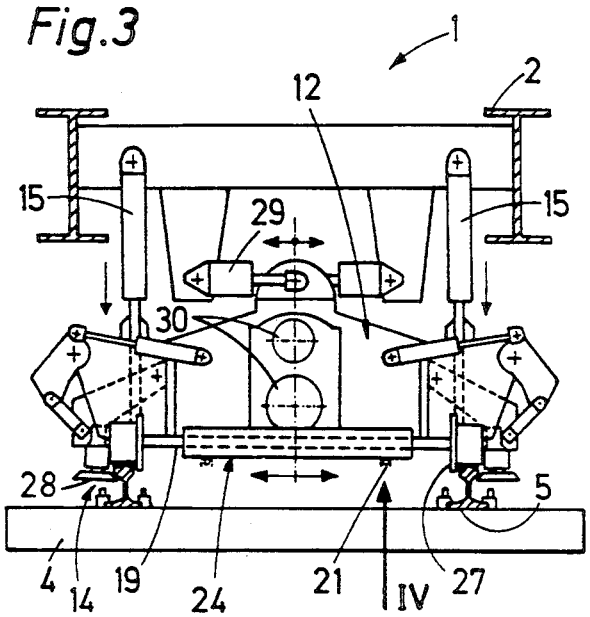
FIG. 3 is an enlarged transverse section along line III of FIG. 1.
Figure 4:
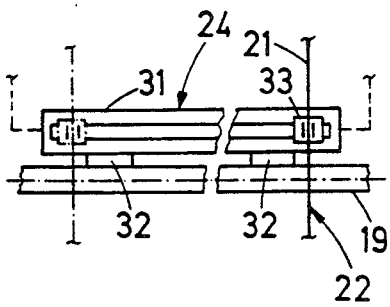
FIG. 4 is an enlarged view showing details of the measuring device, taken in the direction of arrow IV of FIG. 3.

FIG. 3 illustrates a generally conventional dynamic track stabilization assembly, as disclosed in the above-indicated patents, the oscillatory rolling tools 14 of assembly 12 comprising flanged rollers 27 engaging the gage sides of rails 5 without play and horizontally extending flanged rollers 28 subtending the rail heads and engaging the field sides of the track rails without play whereby the track rails are firmly gripped between the rolling tools. The two horizontally extending lining drives 29 link track stabilization assembly 12 to machine frame 2 for displacing the track in either transverse direction and drive means 15 are constituted by two vertically extending hydraulic drives above rails 5 for imparting a static load to the track. Vibrating means 13 are constituted by two eccentric vibrators imparting transverse oscillations to assembly 12.

The illustrated measuring device (see FIGS. 3 and 4) is an oscillation amplitude pickup instrument 31 measuring the linear path of the transverse track displacement and generating an output signal corresponding to the picked-up oscillation amplitude measurement. Two elastic bearings 3 constitute shock absorbers mounting instrument 31 on measuring axle 19. Gliding contact 33 is transversely displaceably mounted on pickup instrument 31 and engages tensioned lining reference wire 21 so that any transverse displacement of the tensioned lining reference wire relative to oscillation amplitude pickup instrument 31, which is held stationary with respect to track 6 by the flanged wheel of measuring axle 19 engaging the track rails, is transmitted to gliding contact 33 without play. A different voltage is measured in dependence on the transverse position of the gliding contact, and this accurately indicates the transverse displacement, which is thus measured. The resultant output signal is transmitted to unit 11 for recording and/or processing after being passed through an electronic filter to filter out any interfering oscillations caused by oscillating track 6.

Dynamic track stabilizer 1 operates in the following manner:

As the machine is continuously propelled along track 6 in the operating direction, track stabilization assemblies 12, 12 are oscillated by vibrating drives 30 to impart horizontal oscillations extending in a transverse direction to the track. At the same time, the four vertical hydraulic drives 15 are operated under the control of leveling reference system 16 to impart a desired static load to track 6 to settle the track at a desired level in the ballast. With the present machine, it is possible to combine this dynamic track stabilization with a track lining operation so that the dynamic track stabilizer becomes a track liner, dispensing with the need for a track lining and tamping machine.

When measuring devices 24 and 25 detect a track lining error with respect to lining reference system 20, the corresponding output signals of the measuring devices will actuate respective lining drives 29 to displace track stabilization assemblies 12 transversely, together with track 6 which is firmly gripped thereby, until the existing lateral track position measured by devices 24, 25 coincides with the desired lateral track position, as is well known in conventional automatic track lining operations. This lining method has the particular advantage that the vibrating track more or less "floats" and, therefore, requires a relatively small lining force for its transverse displacement. In addition, tensions in the track rails due to their transverse displacement tend to be reduced.

In the track lining method of the invention, any deviation of the existing track position from a desired track position relative to a lining reference system is continuously measured to obtain signals indicating the difference between the existing and desired track positions, and the track is transversely displaced in response to these signals by subjecting the track to oscillations extending in a substantially horizontal plane transversely to the track to exert lining forces against the track until the track has been displaced into the desired position. Preferably, continuously advancing track working machine 1 measures and records the existing position of the track in a first pass along track 6 by means of tensioned lining reference wire 21 and measuring devices 24, 25. A conventional track geometry computer in control unit 11 then computes an optimal desired track position on the basis of the recorded existing track position, and, in a subsequent continuous advance of the track working machine, the lining forces exerted by lining drives 29 are automatically controlled in response to the computed deviation of the existing track position from the optimal desired track position, the resultant lateral position is continuously measured by device 24 and compared with the desired track position, and a hydraulic servo-valve so controls lining drives 29 that the difference between the existing and desired lateral track position is zero, i.e. the positions coincide. To damp vibrations of reference wire 21, it may be tensioned by springs attached to the opposite ends thereof and extending at an angle with respect to the wire. This vibration damping effect may be further enhanced by arranging a heavy mass, for example a lead ball, between the end of the wire and the attached spring.

According to another known track lining method, the desired track geometry is obtained by computing the desired track ordinates, and the lining correction values are obtained by a computer from the desired track geometry data and their comparison with a three- or four-point lining reference system.

Figure 5:
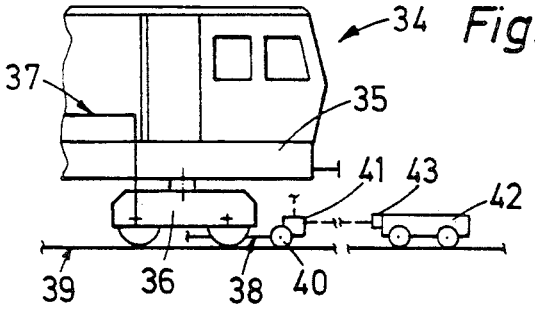
FIG. 5 is a fragmentary side view of the machine, showing a lining reference system incorporating a laser beam emitter and receiver.

FIG. 5 shows an embodiment wherein track working machine 34 comprises machine frame 35 supported on track 39 by swivel trucks 36 and carrying leveling reference system 37 and lining reference system 38. The reference base of the lining reference system is a tensioned wire whose leading end point is connected to carriage 40 rolling on track 39 and moving with machine 34. Laser beam receiver 41 is mounted on carriage 40, independently movable carriage 42 precedes machine frame 35 in the operating direction, and laser beam emitter 43 is mounted on carriage 42. This enables lining reference system 38 carried by machine 34 to be guided along a desired reference line determined by laser beam emitter 43 which moves independently of the machine.

FIG. 6 illustrates a dynamic track stabilizer 45 having rigid machine frame 46 constituting the reference base of lining reference system 46. In this embodiment, the measuring device of the invention comprises capacitative pickup device 48 for measuring the transverse displacement of track 47 and emitting a corresponding output signal. Measuring wheels 50 roll on the track and are rotatable about a transverse axle, the measuring device being connected to machine frame 44 and the transverse measuring wheel axle. Capacitative pickup 48 is a differential condenser and is comprised of two coplanar condenser plates 49 connected to rigid machine frame reference base 44 and slightly spaced from each other in a transverse direction, and condenser plate 51 connected to the transverse measuring axle and slightly spaced from condenser plates 49 in a longitudinal direction extending parallel to the track rails. Any transverse displacement of track 47 causes a corresponding displacement of condenser plate 51 with respect to condenser plates 49, generating a corresponding output signal of pickup 49. To prevent any play between the flange of measuring wheel 50 and the rail used as the reference rail for lining, this wheel is pressed against the gage side of the reference rail by a suitable drive (not shown), as is well known in the art.

In the embodiment shown in FIG. 7, the measuring device is an optoelectronic sensor 54 affixed to rigid machine frame 55 for optically sensing the transverse displacement of track 57 with respect to the machine frame serving as reference base of lining reference system 53. The sensor may be arranged for optically sensing one of the track rails. In the illustrated embodiment, however, displacement reference 56 is fixedly arranged for displacement with the track, the sensor being arranged for optically sensing the displacement reference. Sensor 54 has a CCD-scanning bar with light-permeable electrons and the photos emitted by luminous diode 56 constituting the displacement reference produce a corresponding charging image of the brightness values on the scanning bar. In this way, the transverse displacement of diode 56 can be accurate measured with respect to sensor 54 affixed to machine frame reference base 55, the diode being mounted on the measuring axle connecting measuring wheels 58. The objective of the scanning camera forming optoelectronic sensor 54 is so adjusted that it will focus on diode 56 even when its transverse displacement path is relatively large, as in sharp curves. Any other type of optoelectronic sensor may be used, for example a laser beam distance meter or the like.

What is claimed is:

1. A continuously advancing track working machine for compacting ballast supporting a track comprised of two rails fastened to a succession of ties, each rail having a gage side and a field side, which comprises (a) a self-propelled machine frame supported by undercarriages on the track for mobility in an operating direction, (b) a track stabilization assembly vertically adjustably mounted on the machine frame between two of said undercarriages, the track stabilization assembly comprising (1) drive means for vertically adjusting the assembly, (2) oscillatory rolling tools arranged for engaging the rails for being pressed against the gage sides of the rails, and (3) vibrating means for oscillating the rolling tools, (c) lining drives linking the track stabilization assembly to the machine frame for displacing the track engaged by the rolling tools pressed against the track rails in a direction extending transversely to the track, (d) a lining reference system including a lining reference base having a leading and a trailing end point in the operating direction, (e) a measuring device arranged on the machine frame adjacent the track stabilization assembly for measuring the transverse track displacement relative to the lining reference base into a desired position, (f) an elastic bearing supporting the measuring device, and (g) an electronic filter associated with the measuring device for filtering out any oscillations interfering with the transverse displacement measurements.

2. The track working machine of claim 1, further comprising a measuring axle rolling on the track, the elastic bearing supporting the measuring device on the measuring axle.

3. The track working machine of claim 1, wherein the measuring device is affixed directly to the machine frame.

4. The track working machine of claim 1, comprising a further such measuring device arranged between the first-named measuring device and the trailing end point of the reference base.

5. The track working machine of claim 4, wherein the reference base is a tensioned wire, and further comprising two measuring axles rolling on the track, and elastic bearings supporting the measuring devices on the measuring axles, the measuring devices emitting measuring signals indicating the linear path of the transverse track displacement relative to the tensioned reference wire.

6. The track working machine of claim 1, wherein the machine frame constitutes the reference base.

7. The track working machine of claim 6, wherein the measuring device comprises an optoelectronic sensor affixed to the machine frame for optically sensing the transverse track displacement.

8. The track working machine of claim 7, wherein the sensor is arranged for optically sensing one of the track rails.

9. The track working machine of claim, 7, further comprising a displacement reference fixedly arranged for displacement with the track, the sensor being arranged for optically sensing the displacement reference.

10. The track working machine of claim 6, wherein the measuring device comprises an inductive pickup device for measuring the transverse displacement and emitting a corresponding output signal, and further comprising a measuring axle rolling on the track, the measuring device being connected to the machine frame and the transverse measuring axle.

11. The track working machine of claim 1, comprising two of said track stabilization assemblies sequentially arranged in the operating direction and linked to the machine frame by respective ones of said lining drives, the measuring device being arranged between the track stabilization assemblies.

12. The track working machine of claim 6, wherein the measuring device comprises a capacitative pickup device for measuring the transverse displacement and emitting a corresponding output signal, and further comprising a measuring axle rolling on the track, the measuring device being connected to the machine frame and the transverse measuring axle.

* * * * *